US011528995B2

(12) United States Patent
Chou

(10) Patent No.: US 11,528,995 B2
(45) Date of Patent: Dec. 20, 2022

(54) BALANCING PRESSURE BEARING APPARATUS

(71) Applicant: Great Show Global Co., Ltd., Taipei (TW)

(72) Inventor: Shih-Wei Chou, Taipei (TW)

(73) Assignee: Great Show Global Co., Ltd., Taipei (TW)

( * ) Notice: Subject to any disclaimer, the term of this patent is extended or adjusted under 35 U.S.C. 154(b) by 127 days.

(21) Appl. No.: 17/226,188

(22) Filed: Apr. 9, 2021

(65) Prior Publication Data

US 2022/0312975 A1 Oct. 6, 2022

(30) Foreign Application Priority Data

Mar. 31, 2021 (TW) ..... 110111716

(51) Int. Cl.

| | |
|---|---|
| ***A47C 7/14*** | (2006.01) |
| ***A47C 7/38*** | (2006.01) |
| ***A47C 7/46*** | (2006.01) |
| ***A47C 27/08*** | (2006.01) |

(52) U.S. Cl.

CPC ..... *A47C 7/142* (2018.08); *A47C 7/38* (2013.01); *A47C 7/467* (2013.01); *A47C 27/08* (2013.01)

(58) Field of Classification Search

CPC .. A47C 7/142; A47C 7/14; A47C 7/38; A47C 7/36; A47C 7/467; A47C 7/46; A47C 7/40; A47C 27/08; A47C 27/085; A47C 27/10; A61G 7/05738; A47G 2009/008; Y10S 5/909

USPC ..... 5/722, 652, 653, 654, 655.5, 644, 909

See application file for complete search history.

(56) References Cited

U.S. PATENT DOCUMENTS

| | | | | |
|---|---|---|---|---|
| 4,134,168 A * | 1/1979 | Guigan | ..... | A61G 7/057 5/665 |
| 4,389,742 A * | 6/1983 | DeWitt | ..... | A61G 5/1045 5/654 |
| 5,243,722 A * | 9/1993 | Gusakov | ..... | A61G 5/1043 297/DIG. 3 |

(Continued)

FOREIGN PATENT DOCUMENTS

| | | | | |
|---|---|---|---|---|
| CA | 2708528 A1 * | 6/2009 | ..... | A47C 27/081 |
| DE | 202021102270 U1 * | 8/2021 | ..... | A47C 27/086 |

(Continued)

*Primary Examiner* — Robert G Santos

(57) ABSTRACT

A balancing pressure bearing apparatus including a connecting base and bearing components is provided. Inside the connecting base is any material selected from a volume-incompressibe fluid, semifluid and elastic element, and arranged thereabove is each bearing component. The bearing components have bearing surfaces for supporting any pressing-down human body part and pressure reduction. When the connecting base is pressed down, a Pascal phenomenon is generated for a pressure applied to the fluid, semifluid or elastic element inside the connecting base to be transmitted equally in all directions. Each portion thereof has the same pressure for balancing pressure of the supportive bearing surfaces pressed by any two human body parts, thereby reducing and balancing pressures thereon to achieve a more comfortable contact sensation of pressure release and a correct posture effect. Hence, the invention can serve as a cushion, seat, backrest, mattress or pillow product.

10 Claims, 14 Drawing Sheets

(56) References Cited

U.S. PATENT DOCUMENTS 5,304,271 A * 4/1994 Gusakov ..... A47G 9/10 156/290
5,446,933 A * 9/1995 Gabel ..... A47C 23/065 5/729
5,797,155 A * 8/1998 Maier ..... A61G 5/1054 297/284.6
5,836,027 A * 11/1998 Leventhal ..... A47C 27/20 5/713
5,907,878 A * 6/1999 Thomas ..... A47C 27/082 5/710
6,200,403 B1 * 3/2001 Thomas ..... A47C 27/081 156/292
6,212,719 B1 * 4/2001 Thomas ..... A47C 27/082 601/149
6,519,797 B1 * 2/2003 Brubaker ..... A61G 5/1043 5/710
6,547,911 B2 * 4/2003 Thomas ..... A47C 4/54 156/292
6,551,450 B1 * 4/2003 Thomas ..... A61H 9/0078 297/284.6
6,739,009 B2 * 5/2004 del Drago ..... A47C 27/082 5/709
6,941,602 B2 * 9/2005 Brubaker ..... A61G 5/1045 5/655.3
7,520,011 B1 * 4/2009 Liberkowski ..... A61G 7/05707 5/729
8,572,783 B2 * 11/2013 Moutafis ..... A47C 27/081 5/710
2002/0020486 A1 * 2/2002 Thomas ..... A47C 27/082 156/242
2003/0121102 A1 * 7/2003 Brubaker ..... A61G 7/05769 5/710
2003/0192126 A1 * 10/2003 del Drago ..... A47C 27/082 5/713
2006/0123548 A1 * 6/2006 Heath ..... A47G 9/10 5/655.5
2010/0139003 A1 * 6/2010 Moutafis ..... A61G 7/05769 5/655.3
2014/0215721 A1 * 8/2014 Moutafis ..... A61G 7/05769 5/655.3
2016/0058641 A1 * 3/2016 Moutafis ..... A61G 7/05776 5/672
2016/0206114 A1 * 7/2016 Moutafis ..... A61G 7/05776

FOREIGN PATENT DOCUMENTS

TW 1714261 B 12/2020
WO WO-9746148 A1 * 12/1997 ..... A61G 5/1043
WO WO-2008073326 A1 * 6/2008 ..... A47C 27/081
WO WO-2008073326 A9 * 2/2009 ..... A47C 27/081

* cited by examiner

BALANCING PRESSURE BEARING APPARATUS

BACKGROUND OF THE INVENTION

1. Field of the Invention

The invention is directed to the technical field related to a bearing apparatus for bearing a human body, and more particularly, to a balancing pressure bearing apparatus, when bearing a human body, capable of not only reducing a pressure of a contact part of a human, but also balancing the pressure, so as to provide a more comfortable contact sensation of pressure release and a correct posture effect.

2. Description of the Prior Art

FIG. 1 is a schematic diagram showing a state of a human skeletal system when a human is sitting on a chair. FIG. 2 is a schematic diagram showing an asymmetrical structure of the human with respect to a symmetrical chair surface. Referring to FIG. 1 and FIG. 2, when the human body sits down, the weight of the upper human body is supported on his/her pelvis. When the pelvis of the human body in left and right asymmetry shows inconsistent sizes of left and right piriformis muscles of the hips, the pelvis tilts left and right while sitting, and as the chair surface sit thereby is symmetrical and is incapable of adapting thereto and adjusting heights and supporting forces, it results in the generation of an asymmetrical chair surface pressure, which causes the spine of the neck, chest, waist and hips to tilt as well. As a result, soreness or discomfort occurs to body parts, such as the neck, shoulders, arms, chest, back, waist, hips and legs.

Aiming at the above-mentioned pathological structure problem caused by the left and right asymmetry of pelvis, the inventor of the invention has previously proposed a patented technique for the above-mentioned problem which occurred to general-type chairs and office chairs.

Please refer to Taiwan Patent No. 1714261, entitled "BUTT FIT CHAIR", for the information related to the patent. The "butt fit chair" includes a stand, a chair cushion set held on the stand. The chair cushion set includes a left cushion portion and a right cushion portion arranged side by side. A first elastic element and a second elastic element are further positioned on the stand. The first elastic element is connected to the bottom of the left cushion portion for a user's left hip, when sitting on the left cushion portion, to push the left cushion portion to move downward, and the second elastic element is connected to the bottom of the right cushion portion for the user's right hip, when sitting on the right cushion portion, to push the right cushion portion to move downward, and both will return to the original position when the pressure disappears.

The effect of the above-mentioned patent lies in that for the two hips of the user, when respectively sitting on the left and right cushion portions, according to the difference of the sizes and heights of the two hips, the height can be independently and automatically adjusted, and a total weight-bearing area can be increased, so as to achieve effective and comfortable pressure-reduction support.

It is apparent that in the above-mentioned patent, the objective of independent and automatic height adjustment according to the difference of the sizes and heights of the two hips can be achieved by applying the compressibility and elastic recovery. Further, in the embodiments of the first elastic element and the second elastic element, compression springs are selected, and there is a linear relationship between stress and strain (a unit deformation amount) after a solid material (the compression spring) receives a force according to the Hooke's law in the theory of mechanical elasticity, such that even though the total weight-bearing area of the left and right cushion portions arranged above the left and right compression springs and serving as weight-bearing components is increased, a situation where left and right pressures are not equal will occur when the left and right weight-bearing areas are not exactly the same, and the weight born by the left and right are not the same.

To sum up, in other words, even though the separated left and right cushion portions are capable of independently and automatically adjusting the height, increasing the total weight-bearing area and reducing the pressure according to the difference of the sizes and heights of the two hips, they are not provided with an effect of balancing the pressures received by the bottoms of the left and right hips, and therefore, the comfort of left and right hip bottom pressure release still needs to be improved.

According to the description set forth above, it is indeed necessary to carry out a structural innovation and/or design for the aforementioned patent, so as to balance the pressures received by the bottoms of the left and right hips and provide a more comfortable contact sensation of pressure release. In light of the foregoing, the inventor of the invention has made much effort in research and invention and eventually, a balancing pressure bearing apparatus of the invention has been developed and completed.

SUMMARY OF THE INVENTION

An objective of the invention is to provide a balancing pressure bearing apparatus, including a connecting base and a plurality of bearing components. A material inside the connecting base is any one selected from a volume-incompressible fluid, semifluid and elastic element. Each of the bearing components is separately arranged above the connecting base. Particularly, the plurality of bearing components have supportive bearing surfaces for any human body part that presses down and are capable of pressure reduction, and when the bearing components press down the connecting base, a Pascal (Pa) phenomenon may be generated to enable the pressure applied to the fluid, semifluid or elastic element inside the connecting base to be transmitted equally to each portion. Further, each portion of the fluid, semifluid and elastic element has the same pressure for balancing the pressure on the supportive bearing surfaces pressed down by any two parts of the human body.

As such, when any two parts of the human body, such as left and right hips, sit on the left and right bearing components, not only the pressures on the left and right hip bottoms may be reduced and balanced, but also a more comfortable contact sensation of pressure release may be provided to achieve a correct posture effect, which renders the invention to serve as a cushion, seat, backrest, mattress or pillow product.

Hence, in order to achieve the objective of the invention, a balancing pressure bearing apparatus provided according to an embodiment of the invention includes:

a connecting base, being enclosed, and a material thereinside being any one selected from a volume-incompressible fluid, semifluid and elastic element, the outside of the connecting base being deformed for adapting to an external pressure to generate a connecting pipe phenomenon and a Pascal (Pa) phenomenon; and a plurality of separated bearing components, a material of each of the bearing components being selected from either elastic or rigid material, each of the bearing components being separately arranged above the connecting base, and each of the bearing components comprising an upper layer body and a lower layer body;

wherein the bearing components serve as independent supportive bearing surfaces for any part of a human body when pressing down in left and right, front and back, or inside and outside asymmetry, or in a tilting asymmetric state, and are capable of pressure reduction, and when the bearing components bear any part of the human body and press down the connecting base, the Pa phenomenon is generated by the volume incompressibility of the fluid, semifluid or elastic element, such that a pressure applied to the fluid, semifluid or elastic element by the bearing components is transmitted equally to each portion through the fluid, semifluid or elastic element, and each portion of the fluid, semifluid and elastic element has the same pressure for balancing the pressure on the supportive bearing surfaces pressed down by any two parts of the human body.

In an embodiment, the material selected for the inside of the connecting base is, for example, any one of silicone oil, jelly silicone, low hardness silicone and latex.

In an embodiment, the connecting base is provided on a bearing base, and the bearing base is provided with a concaved accommodation space for arranging the connecting base.

In an embodiment, a material of the bearing base is selected from a rigid material, such as high hardness silicone.

In an embodiment, the plurality of bearing components, either before or after bearing the human body, keep at least a portion protruding from an upper edge of the bearing base.

In an embodiment, the upper layer body of each of the bearing components is an elastic element or a rigid element, and the lower layer body of each of the bearing components is a rigid element, such as high hardness silicone.

In an embodiment, each of the bearing components are arranged in a left and right symmetry manner above the connecting base for correspondingly bearing any two parts of the body parts to serve as a cushion, a chair seat or a backrest.

In an embodiment, the upper layer body of each of the bearing components is smaller than the lower layer body of each of the bearing components, such that the upper layer bodies of the bearing components have a spacing distance from each other, and are wrapped and breathable, free from mutual interference and clamping human skin for defining the a zero-pressure region, and the lower layer bodies lean against each other on the sides, and are independently separated but in an enclosed plane for defining a balanced-pressure region.

In an embodiment, the upper layer body of each of the bearing components is either a rectangular body or a square body, and the lower layer body of each of the bearing components is either a rectangular body or a square body.

In an embodiment, the upper layer body of each of the bearing components is circular, and the lower layer body of each of the bearing components is either rectangular or square.

In an embodiment, the lower layer bodies of the bearing components lean against each other on the sides.

In an embodiment, a left bearing component arrangement region and a right bearing component arrangement region are defined above the connecting base, the plurality of bearing components are arranged in the left bearing component arrangement region and the right bearing component arrangement region, and there is a spacing distance between the left bearing component arrangement region and the right bearing component arrangement region for defining a zero-pressure region in the middle.

In an embodiment, the bearing components are independent of each other, the upper layer bodies are spaced from each other, and the lower layer bodies are enclosed.

In an embodiment, the upper layer body of each of the bearing components is smaller than the lower layer body of each of the bearing components, such that the upper layer bodies of the bearing components have a spacing distance from each other for defining the zero-pressure region, the lower layer bodies lean against each other on the sides, and are independently separated but in an enclosed plane for defining the balanced-pressure region, and each of the bearing components further defines a plurality of separate sub lower layer bodies for conforming or adapting to asymmetric body parts or posture asymmetry.

In an embodiment, the bearing components are independent of each other, the upper layer bodies are spaced from each other, and the lower layer bodies are enclosed.

In an embodiment, each of the bearing components is arranged evenly above the connecting base for bearing the human body to serve as a mattress, headrest or backrest product.

BRIEF DESCRIPTION OF DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

In order to more clearly describe a balancing pressure bearing apparatus provided by the invention, preferred embodiments of the invention will be described in detail in accordance with the accompanying drawings hereinafter.

First, the principles applied by the invention are described.

Principle of connecting pipe: after a liquid is injected into containers with bottoms connected with each other (referred to as a connecting pipe), the liquid flows from high to low, and because each pipe mouth has the same pressure, the liquid level is certainly on the same plane when the liquid level is in stillness, which is independent of the container shape, length and thickness.

Pascal's (Pa) principle:

The pressure applied to an enclosed liquid will be transmitted equally in all directions through the liquid, and thus, each portion of the enclosed liquid has the same pressure.

First Embodiment

Figure 1:
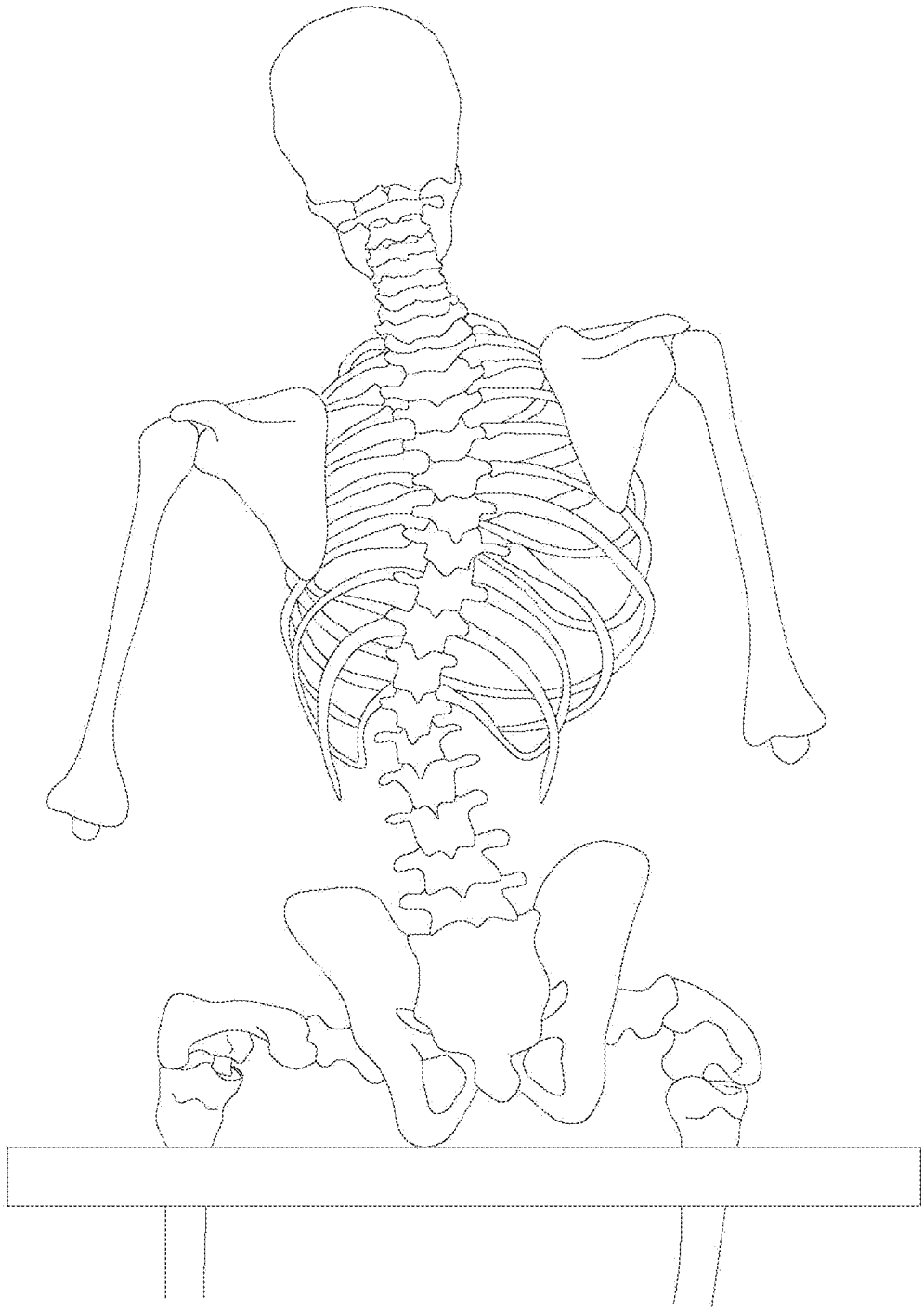
FIG. 1 is a schematic diagram showing a state of a human skeletal system when a human is sitting on a chair.
Figure 2:
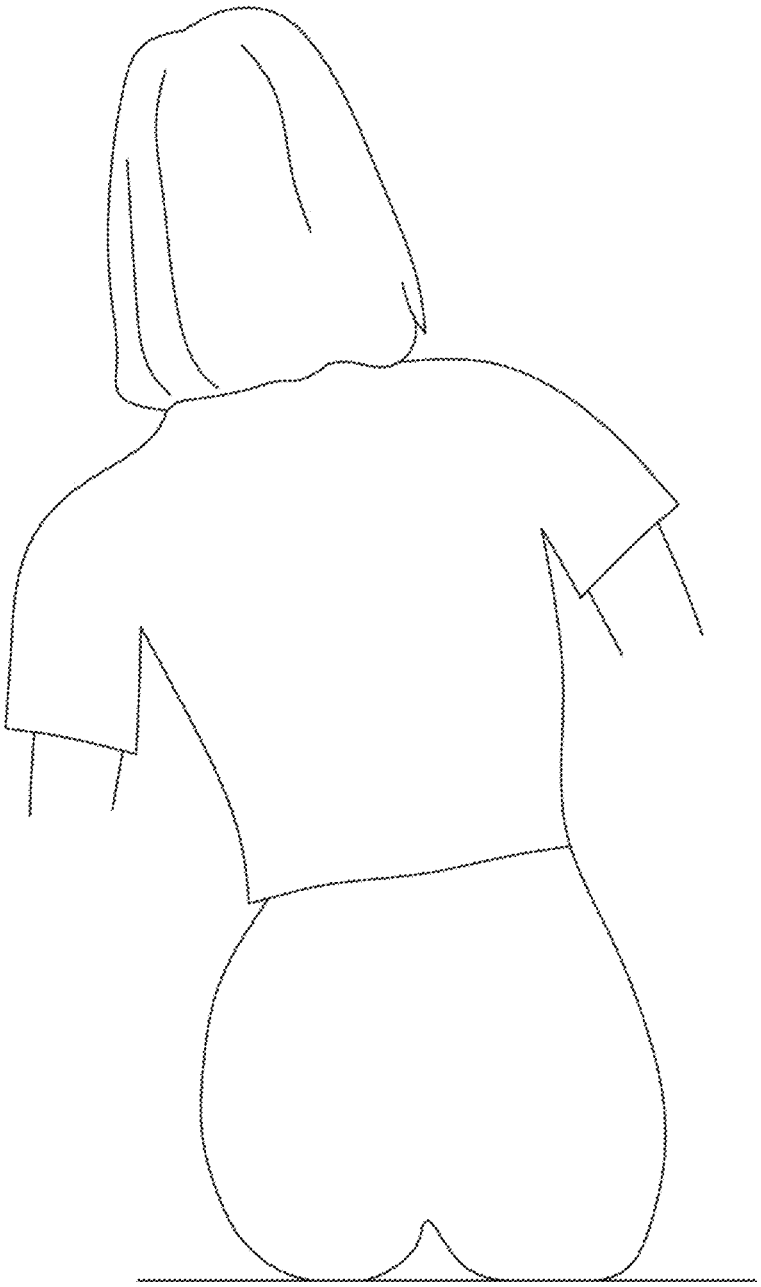
FIG. 2 is a schematic diagram showing an asymmetrical structure of the human with respect to a symmetrical chair surface.
Figure 3:
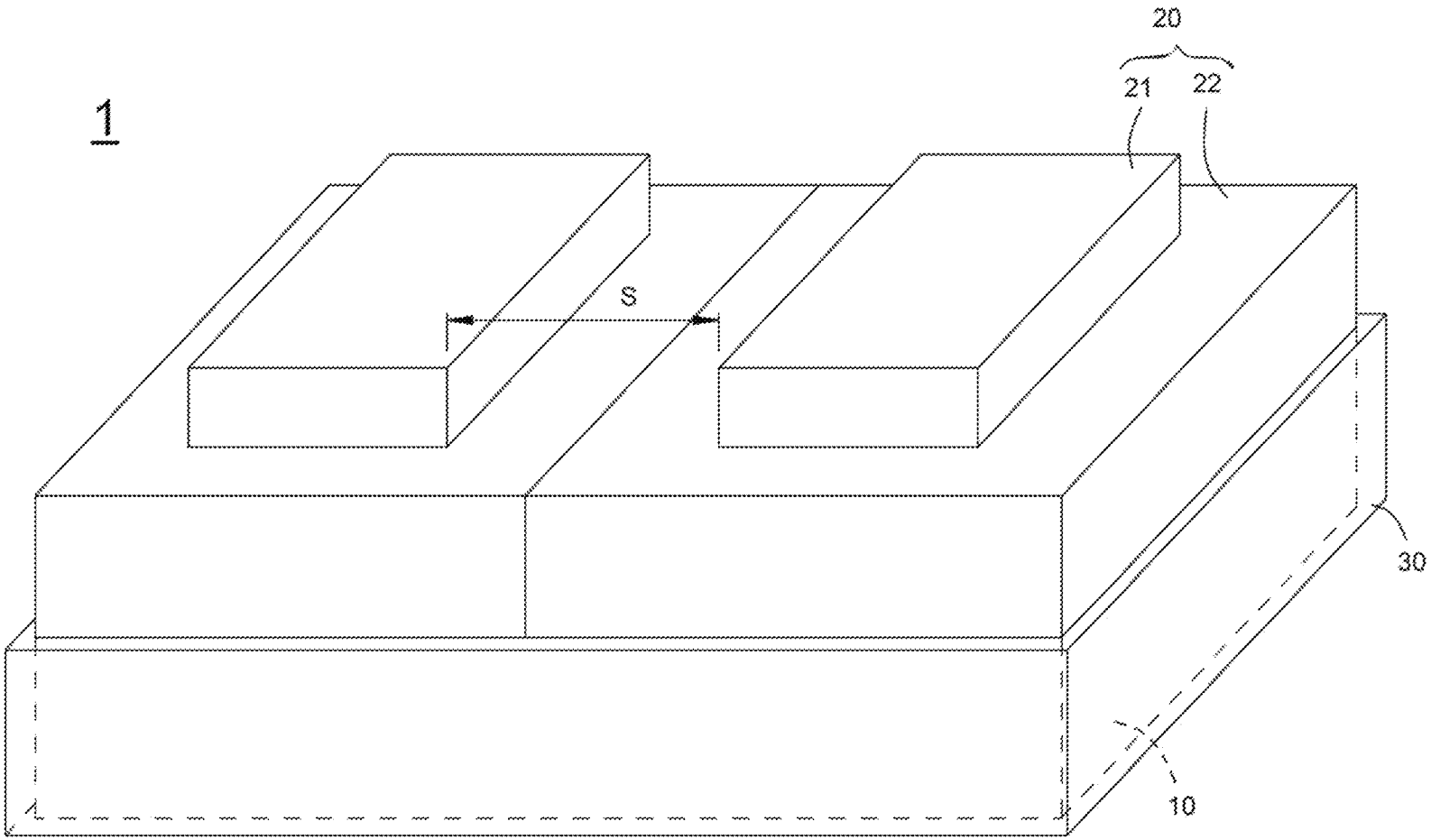
FIG. 3 is a perspective diagram showing a balancing pressure bearing apparatus of a first embodiment of the invention.
Figure 4:
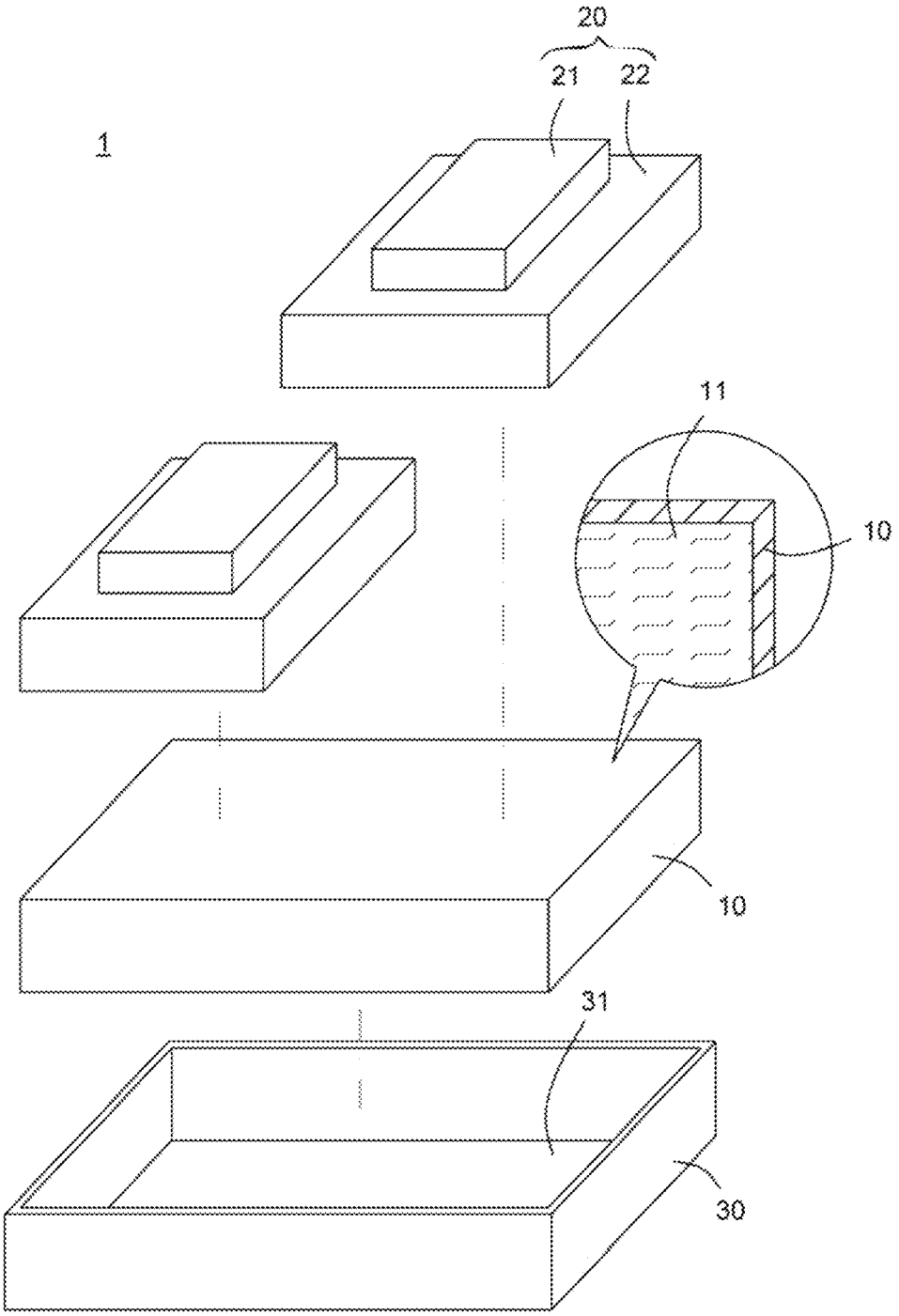
FIG. 4 is an exploded perspective diagram showing the balancing pressure bearing apparatus of the first embodiment of the invention.
Figure 5:
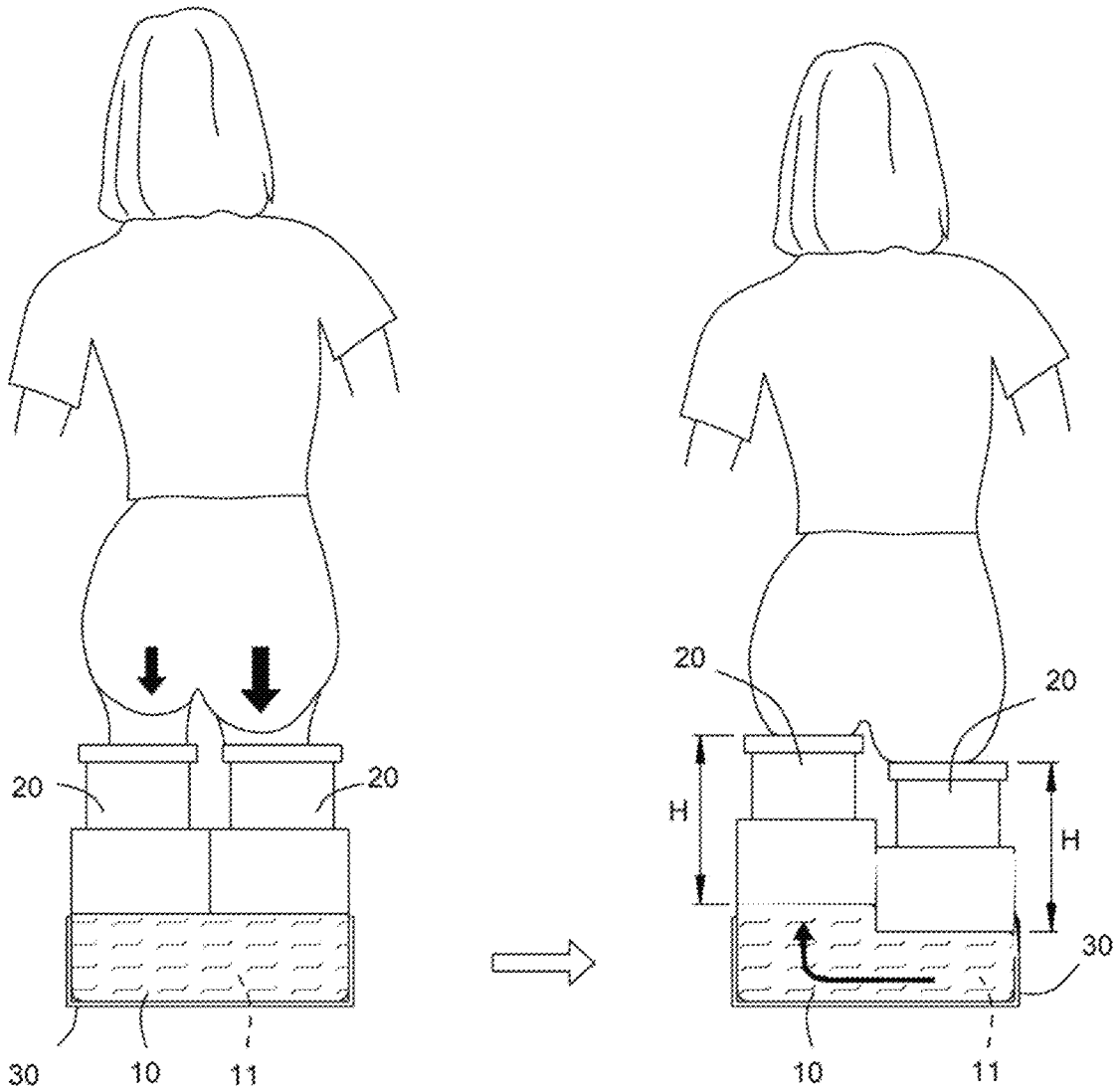
FIG. 5 is a schematic diagram showing a balancing pressure bearing apparatus of an example of use of the invention.

FIG. 3 is a perspective diagram showing a balancing pressure bearing apparatus of the first embodiment of the invention. FIG. 4 is an exploded perspective diagram showing the balancing pressure bearing apparatus of the first embodiment of the invention. FIG. 5 is a schematic diagram showing a balancing pressure bearing apparatus of an example of use of the invention.

Referring to FIG. 3 and FIG. 4, a balancing pressure bearing apparatus 1 of the invention includes a connecting base 10 and a plurality of bearing components 20.

The connecting base 10 is enclosed, and a material inside the connecting base 10 is any one selected from a volume-incompressibe fluid 11, semifluid and elastic element. The outside of the connecting base 10 may be deformed for adapting to an external pressure to achieve a connecting pipe effect and a Pascal (Pa) effect.

Each of the bearing components 20 is made of a material selected from either an elastic material or a rigid material, each of the bearing components 20 is separately arranged above the connecting base 10, and each of the bearing components 20 includes an upper layer body 21 and a lower layer body 22.

The upper layer body 21 of each of the bearing components 20 is used to form a bearing surface which is capable of independently bearing the weight and increasing a force and contact area, and is wrapping and breathable, free from mutual interference and clamping human skin for defining a zero-pressure region. The upper layer body 21 serves as a force-applying point, a force-receiving point, a force arm or a fulcrum point which is capable of generating a leverage when the invention is applied.

The lower layer body 22 of each of the bearing components 20 is used to form an enclosed bearing.

Referring to FIG. 5, particularly, the separately arranged bearing components 20 serve as supportive bearing surfaces for any part of a human body when pressing down in left and right, front and back, or inside and outside asymmetry and in a tilting asymmetric state, and when the bearing components 20 bear any part of the human body and press down the connecting base 10, a Pa phenomenon may be generated by the volume incompressibility of the fluid 11, semifluid or elastic element, such that the pressure applied to the fluid, semifluid or elastic element by the bearing components may be equally transmitted to each portion through the fluid 11, semifluid or elastic element, and each portion of the fluid, semifluid and elastic element has the same pressure for balancing the pressure on the supportive bearing surfaces pressed down by any two parts of the human body.

As such, when any two parts of the human body, such as left and right hips, sit on the left and right bearing components 20 with difference sizes and shapes or different force sizes, the left and right bearing components 20 may not only reduce and balance the pressures on the left and right hip bottoms, but also provide a more comfortable contact sensation of pressure release to achieve a correct posture effect, so as to serve as a cushion, seat, backrest, mattress, or pillow product.

Arrows in different sizes at the left and right hips of the human body shown in FIG. 5 represent different pressing-down force sizes. When the left and right bearing components 20 respectively support the left and right hips, and the left and right hips sit and press down with different sizes and shapes or different force sizes, the left and right bearing components 20 still keep the same height H with each other, which represents that pressures on the supportive bearing surfaces of the left and right bearing components 20 are the same. In this way, the left and right cushion portions in the prior art may be improved even though the total weight-bearing area is increased. However, when the weight-bearing areas on the left and right are not exactly the same, and the weights born on the left and right are not the same, a situation where the pressures are not equal will occur.

In addition, as human musculoskeletal joints are not rigid but tough structures, a vertical force of the human body weight, plus the left and right ischium bones are separated and linked for the bearing, which is just like that taught in principle of connecting pipe, the left and right body parts including the hips may achieve a natural balanced-pressure state.

Referring to FIG. 3 and FIG. 4, in an embodiment, the material selected for the inside of the connecting base 10 is any one of silicone oil, jelly silicone, low hardness silicone and latex.

In an embodiment, the connecting base 10 is provided on a bearing base 30. The bearing base 30 is provided with a concaved accommodation space 31 for arranging the connecting base 10 and provides an enclosed space with a fixed volume.

In an embodiment, the material of the bearing base 30 is selected from a high hardness silicone.

In an embodiment, the plurality of bearing components 20, either before or after bearing the human body, keeps at least a portion protruding from an upper edge of the bearing base 30.

In an embodiment, the upper layer body 21 of each of the bearing components 20 is an elastic element or a rigid element, and the lower layer body 22 of each of the bearing components 20 is a rigid element, such as high hardness silicone.

In an embodiment, each of the bearing components 20 is arranged above the connecting base 10 in a left and right symmetry manner for correspondingly bearing any two of the body parts, such as the left and right hips to serve as a cushion, chair seat, or backrest product.

In an embodiment, the upper layer body 21 of each of the bearing components 20 is smaller than the lower layer body 22 of each of the bearing components 20, thereby forming a shape with a small top and a large bottom. In this way, the upper layer bodies 21 of the bearing components 20 have a spacing distance S from each other for defining a zero-pressure region, and the lower layer bodies 22 lean against each other on their sides, and are independently separated but in an enclosed plane, thereby defining a balanced-pressure region.

In other words, when the left and right bearing components 20 correspond to the left and right hips, the pressures on the left and right ischium bones are balanced, and the zero-pressure region defined by the spacing distance S and corresponding to the sacral vertebrae has zero pressure.

In an embodiment, the upper layer body 21 of each of the bearing components 20 is either a rectangular body or a square body, and the lower layer body 22 of each of the bearing components 20 is either a rectangular body or a square body.

Second Embodiment

Figure 6:
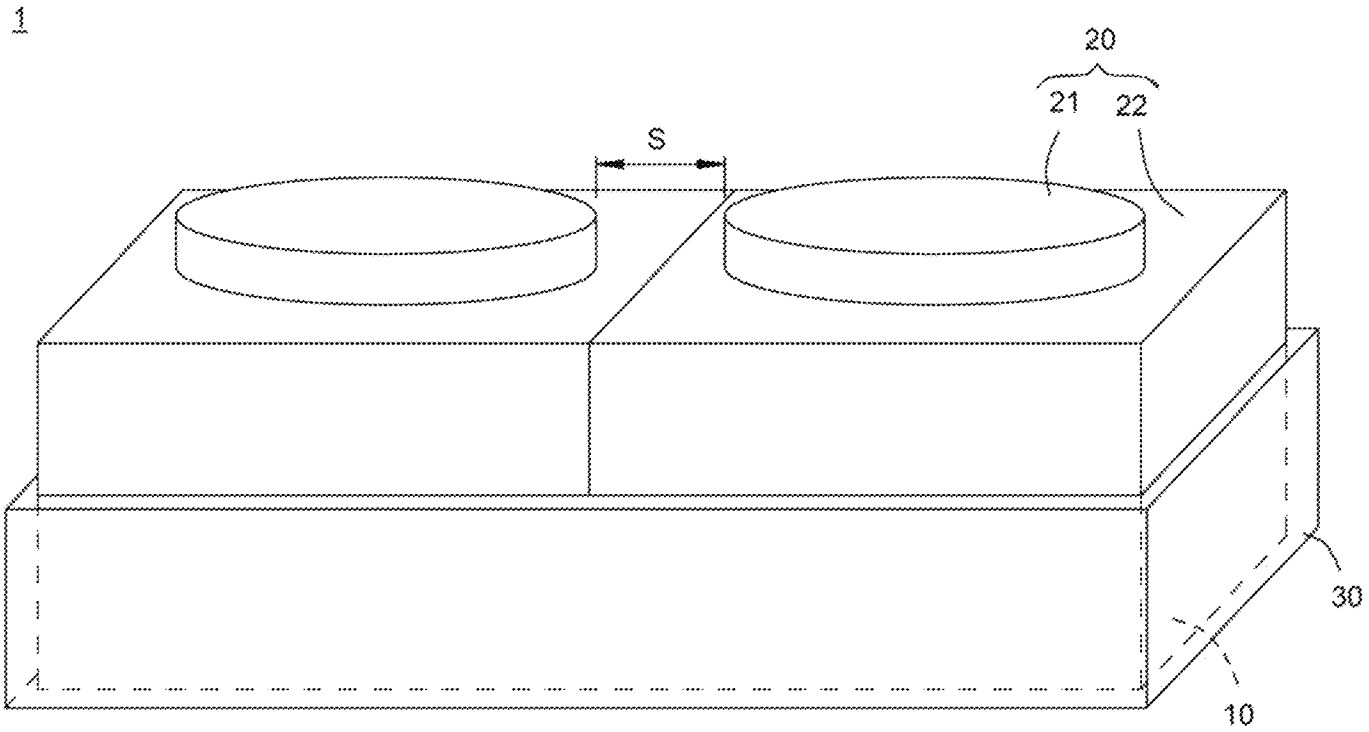
FIG. 6 is a perspective diagram showing a balancing pressure bearing apparatus of a second embodiment of the invention.
Figure 7:
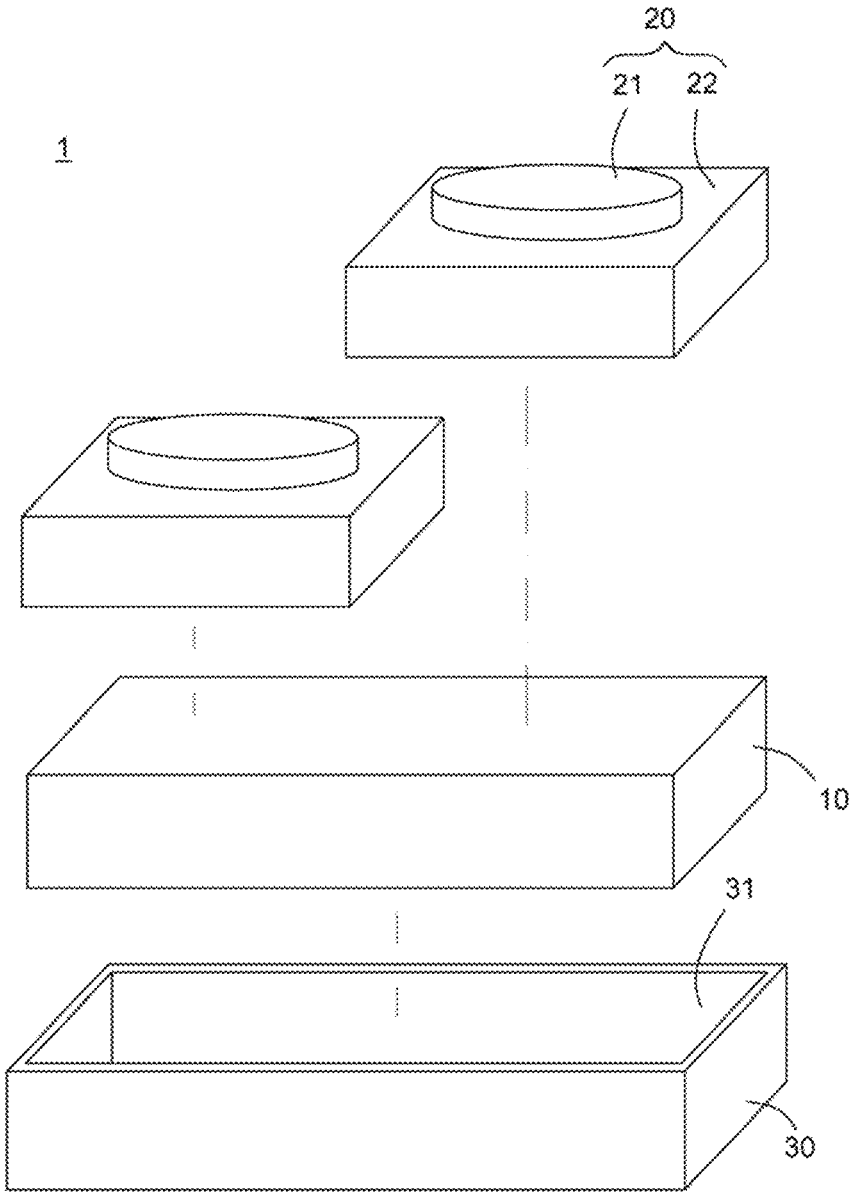
FIG. 7 is an exploded perspective diagram showing the balancing pressure bearing apparatus of the second embodiment of the invention.

FIG. 6 is a perspective diagram showing a balancing pressure bearing apparatus of the second embodiment of the invention. FIG. 7 is an exploded perspective diagram showing the balancing pressure bearing apparatus of the second embodiment of the invention.

Referring to FIG. 6 and FIG. 7, the balancing pressure bearing apparatus 1 of the second embodiment of the invention is shown. Herein, the upper layer body 21 of each of the bearing components 20 is circular, and the lower layer body 22 of each of the bearing components 20 is either rectangular or square, thereby forming a shape with a circular top and a square bottom. Accordingly, in the same way as the balancing pressure bearing apparatus 1 of the first embodiment, the upper layer bodies 21 of the bearing components have a spacing distance S from each other, thereby defining the zero-pressure region, and the lower layer bodies 22 define the balanced-pressure region.

The upper layer body 21 of each of the bearing components 20 is circular for wrapping and being breathable, increasing the weight-bearing and contact area, and being free from mutual interference and clamping human skin, thereby defining the zero-pressure region.

In the balancing pressure bearing apparatus 1 of the second embodiment of the invention, the lower layer bodies 22 of the bearing components 20 lean against each other on their sides, and are independently separated but in an enclosed plane.

Third Embodiment

Figure 8:
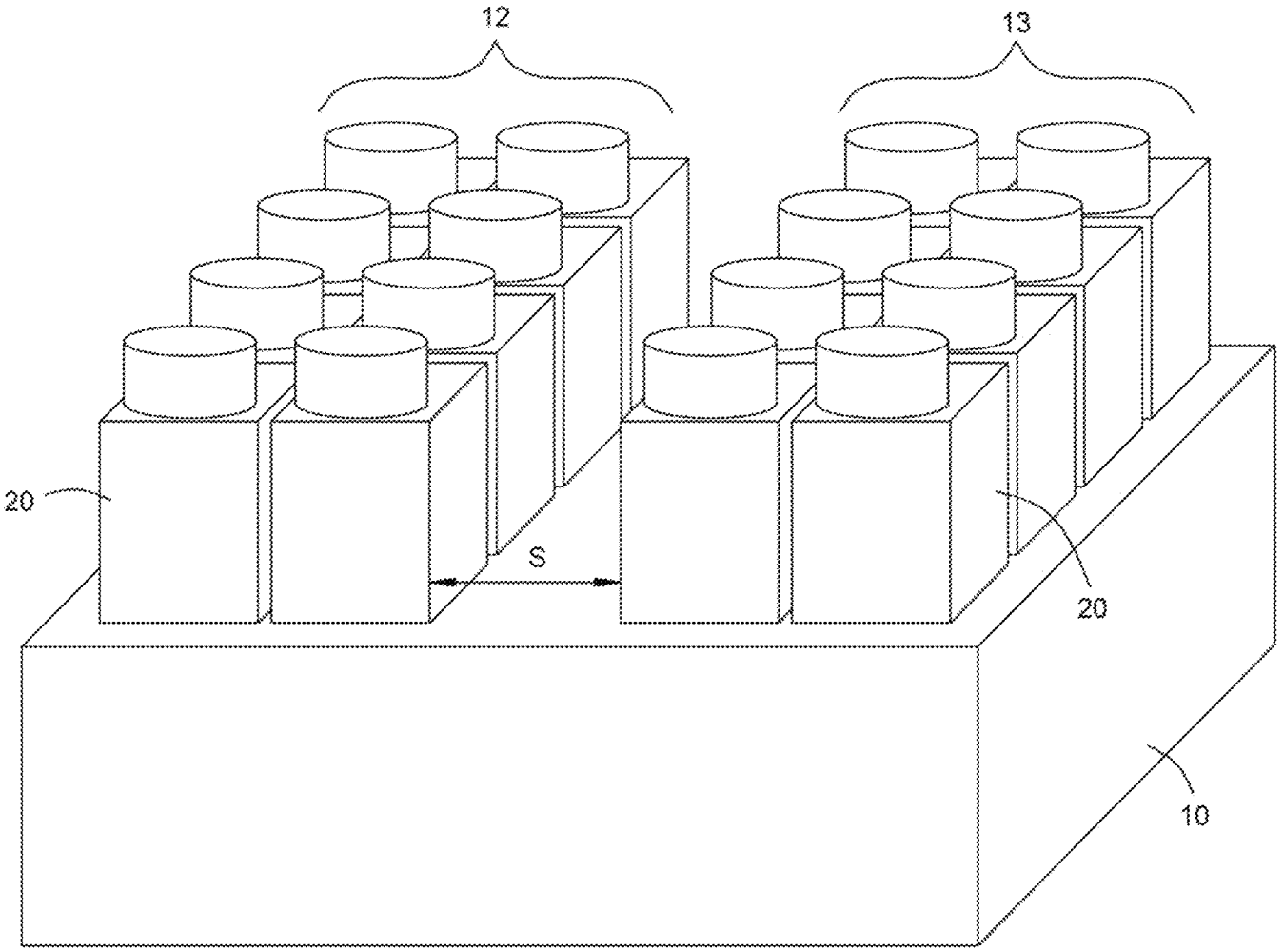
FIG. 8 is a perspective diagram showing a balancing pressure bearing apparatus of a third embodiment of the invention.

FIG. 8 is a perspective diagram showing a balancing pressure bearing apparatus of the third embodiment of the invention;

Referring to FIG. 8, the balancing pressure bearing apparatus 1 of the third embodiment of the invention is shown. Herein, a left bearing component arrangement region 12 and a right bearing component arrangement region 13 are defined above the connecting base 10, and the plurality of bearing components 20 are arranged in the left bearing component arrangement region 12 and the right bearing component arrangement region 13. There is a spacing distance S between the left bearing component arrangement region 12 and the right bearing component arrangement region 13 for defining the zero-pressure region.

In the balancing pressure bearing apparatus 1 of the third embodiment of the invention, the bearing components 20 are independent, spaced from each other, and enclosed.

Fourth Embodiment

Figure 9:
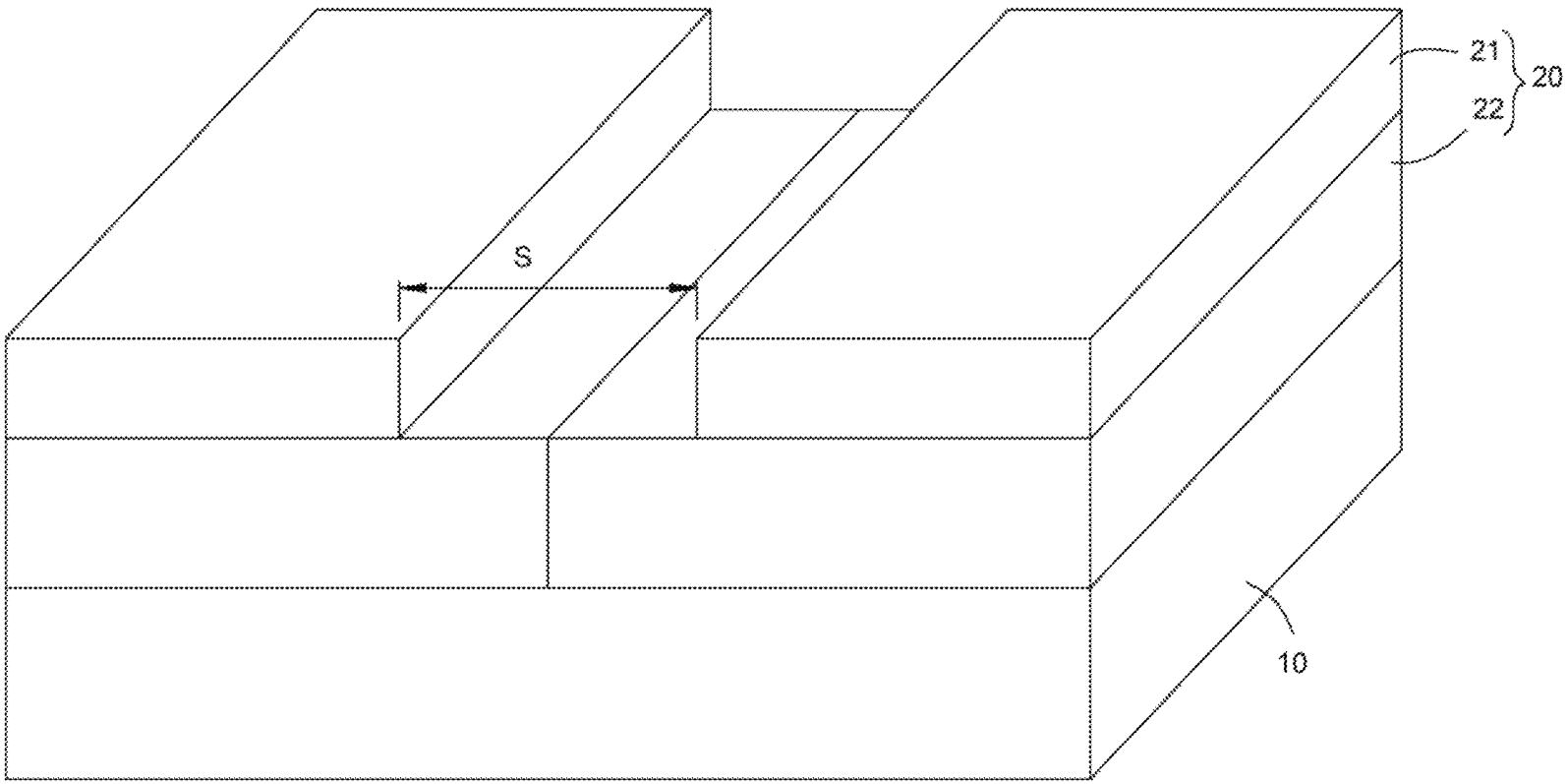
FIG. 9 is a perspective diagram showing a balancing pressure bearing apparatus of a fourth embodiment of the invention.
Figure 10:
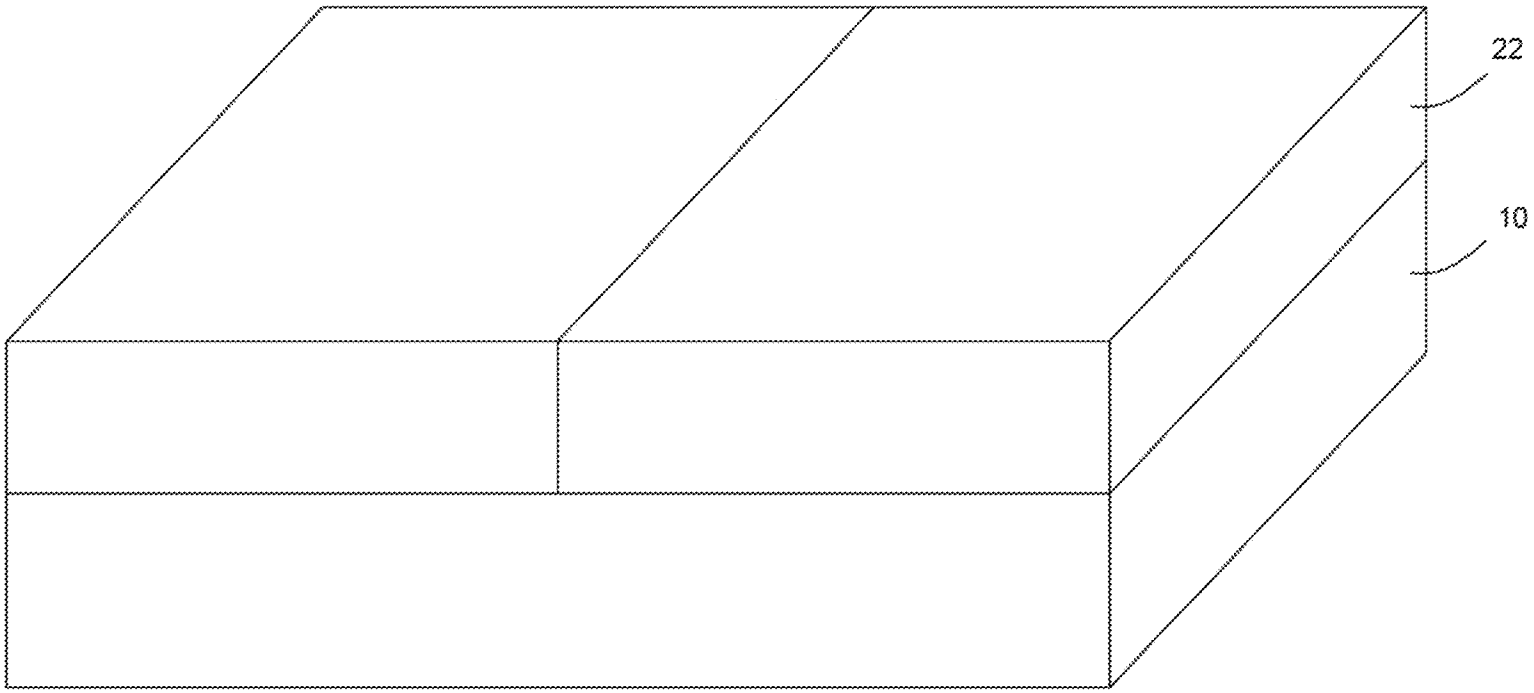
FIG. 10 is a perspective diagram showing the balancing pressure bearing apparatus of the fourth embodiment of the invention where bearing components thereof are not provided with upper layer bodies.
Figure 11:
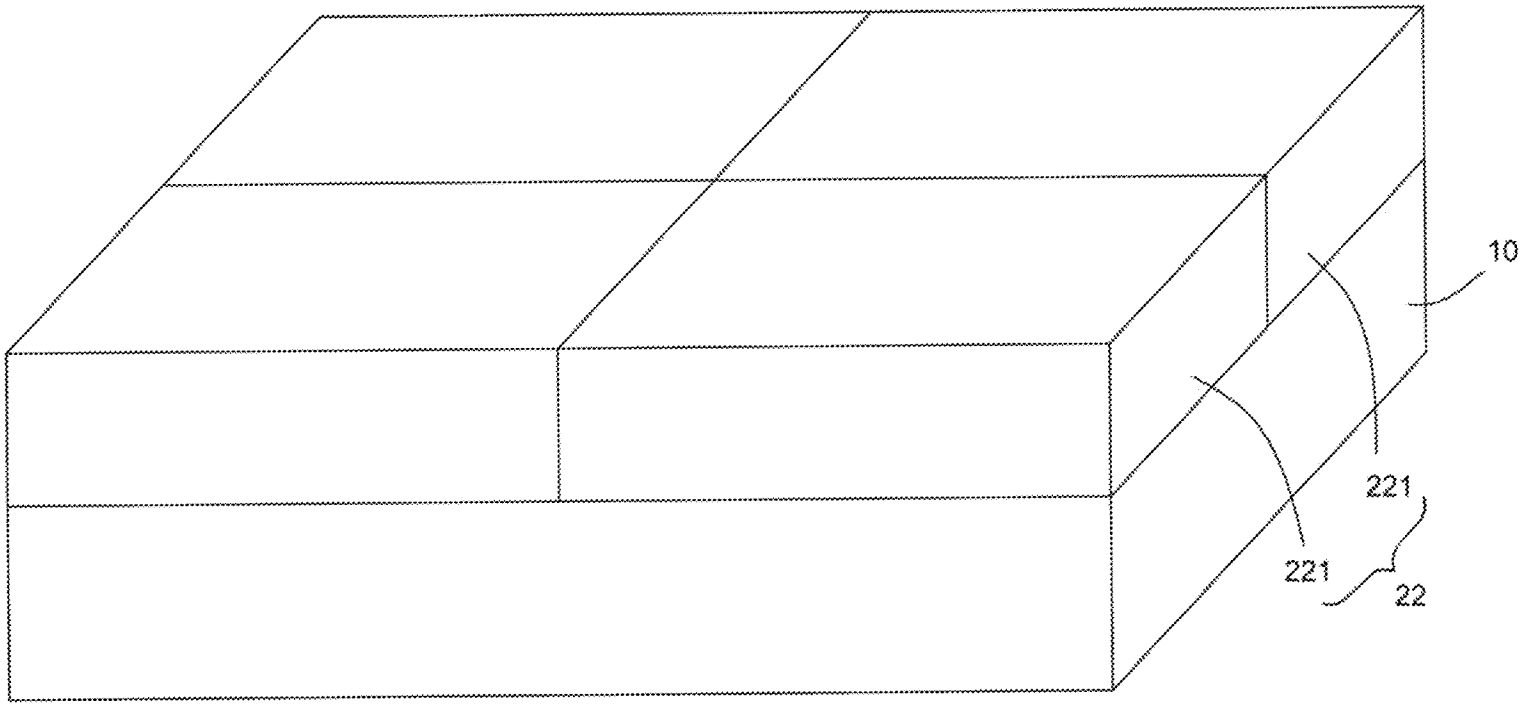
FIG. 11 and FIG. 12 are perspective diagrams showing the balancing pressure bearing apparatus of the fourth embodiment of the invention where lower layer bodies of the bearing components are capable of further defining a plurality of sub lower layer bodies.
Figure 12:
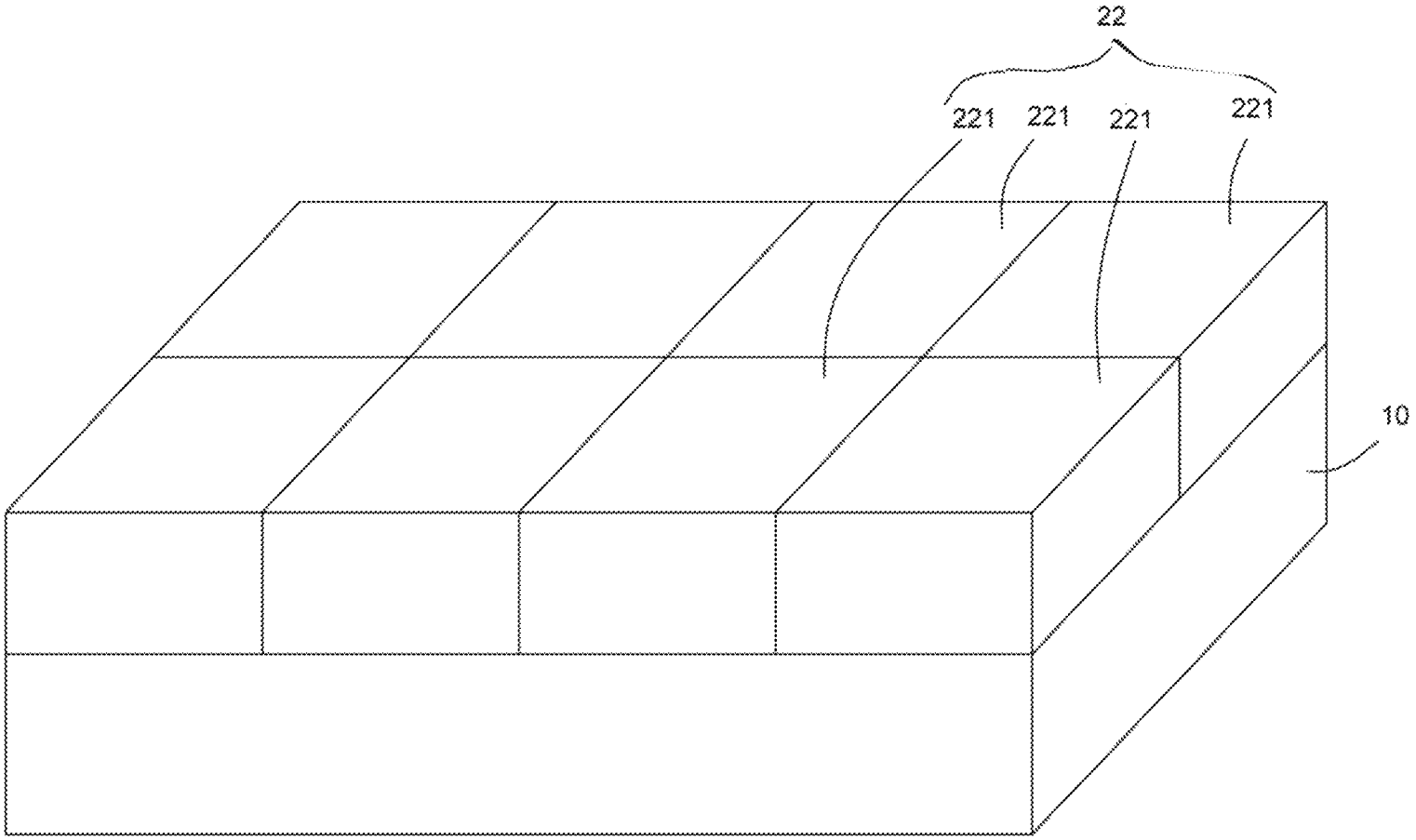

FIG. 9 is a perspective diagram showing a balancing pressure bearing apparatus of the fourth embodiment of the invention. FIG. 10 is a perspective diagram showing the balancing pressure bearing apparatus of the fourth embodiment of the invention where the bearing components thereof are not provided with the upper layer bodies. FIG. 11 and FIG. 12 are perspective diagrams showing the balancing pressure bearing apparatus of the fourth embodiment of the invention where the lower layer bodies of the bearing components are capable of further defining a plurality of sub lower layer bodies.

Referring to FIG. 9, FIG. 10, FIG. 11 and FIG. 12, the balancing pressure bearing apparatus of the fourth embodiment of the invention is shown. Herein, the upper layer body 21 of each of the bearing components 20 is smaller than the lower layer body 22 of each of the bearing components 20, such that the upper layer bodies 21 of the bearing components 20 have a spacing distance S from each other for defining the zero-pressure region, the lower layer bodies 22 define the balanced-pressure region, and the lower layer bodies 22 of the bearing components 20 further define a plurality of separate sub lower layer bodies 221. The lower layer bodies 221 lean against each other on their sides, and are independently separated but in an enclosed plane, thereby defining the balanced-pressure region for conforming or adapting to asymmetric body parts or posture asymmetry.

In the balancing pressure bearing apparatus of the fourth embodiment of the invention, the sub lower layer bodies 221 are separated from each other, and are enclosed.

An actual design example where the lower layer bodies 22 and the sub lower layer bodies 221 capable of conforming or adapting to asymmetric body parts or posture asymmetry will be described in detail below.

Referring to FIG. 10, the lower layer bodies 22, when being arranged side by side, may conform or adapt to the left and right asymmetry of the human body.

Referring to FIG. 11, the lower layer bodies 22, when further defining two sub lower layer bodies 221 arranged in a line, may conform or adapt to single-side asymmetry at the left or at the right of the human body, or to hip or leg asymmetry.

Referring to FIG. 12, the lower layer bodies 22, when further defining four sub lower layer bodies 221 arranged side by side, may conform or adapt to hip or leg asymmetry or arc asymmetry.

In summary, the number of the sub lower layer bodies 221 of the each of the lower layer bodies 22 may be increased according to actual requirements. The greater the number of the sub lower layer bodies 221 is, the more the sub lower layer bodies 221 may conform or adapt to the asymmetric body parts or posture asymmetry. The number of the sub lower layer bodies 221 is preferablely, but not limited to, 4.

Fifth Embodiment

Figure 13:
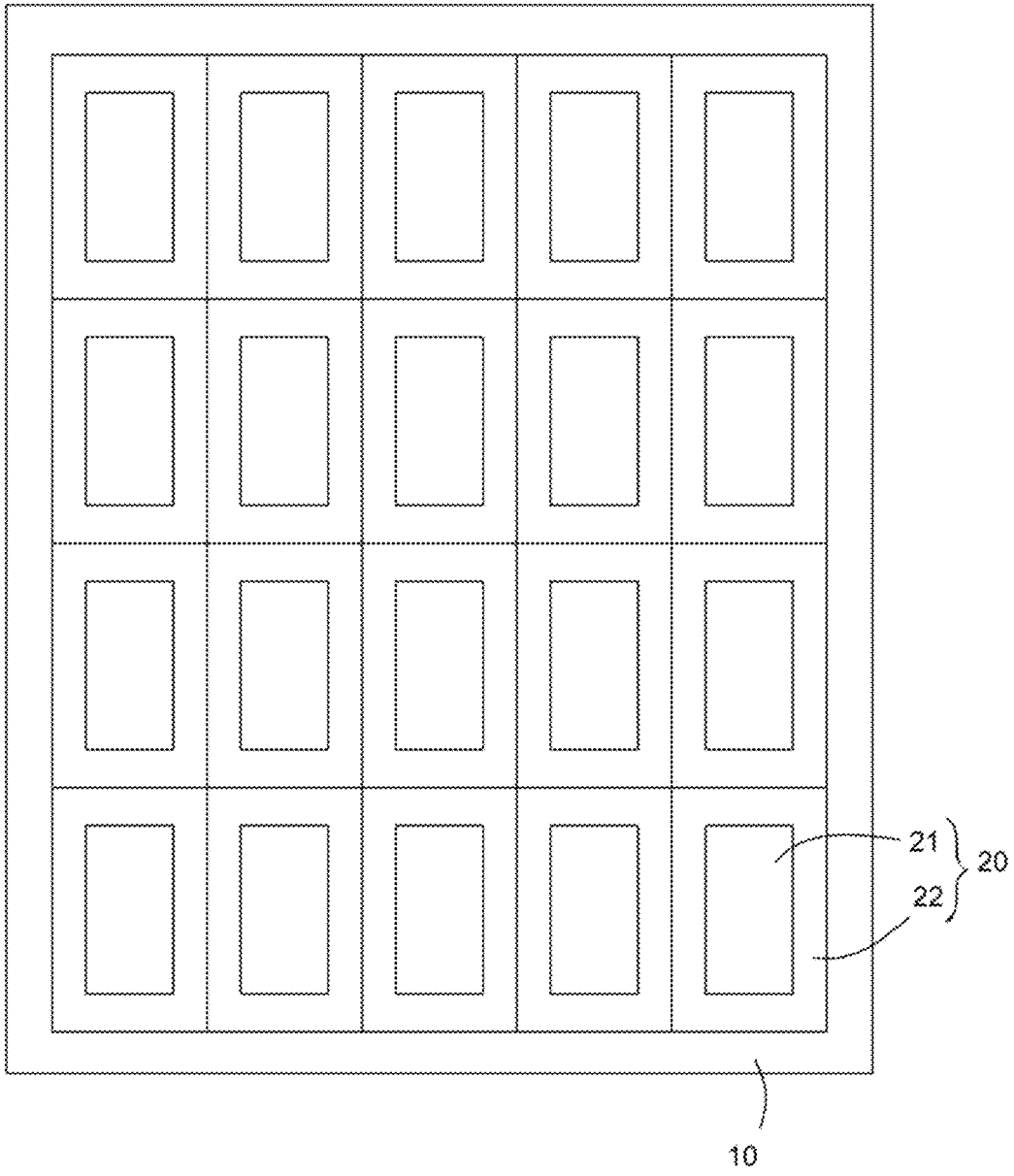
FIG. 13 is a top view showing a balancing pressure bearing apparatus of a fifth embodiment of the invention where the upper layer bodies are rectangular.
Figure 14:
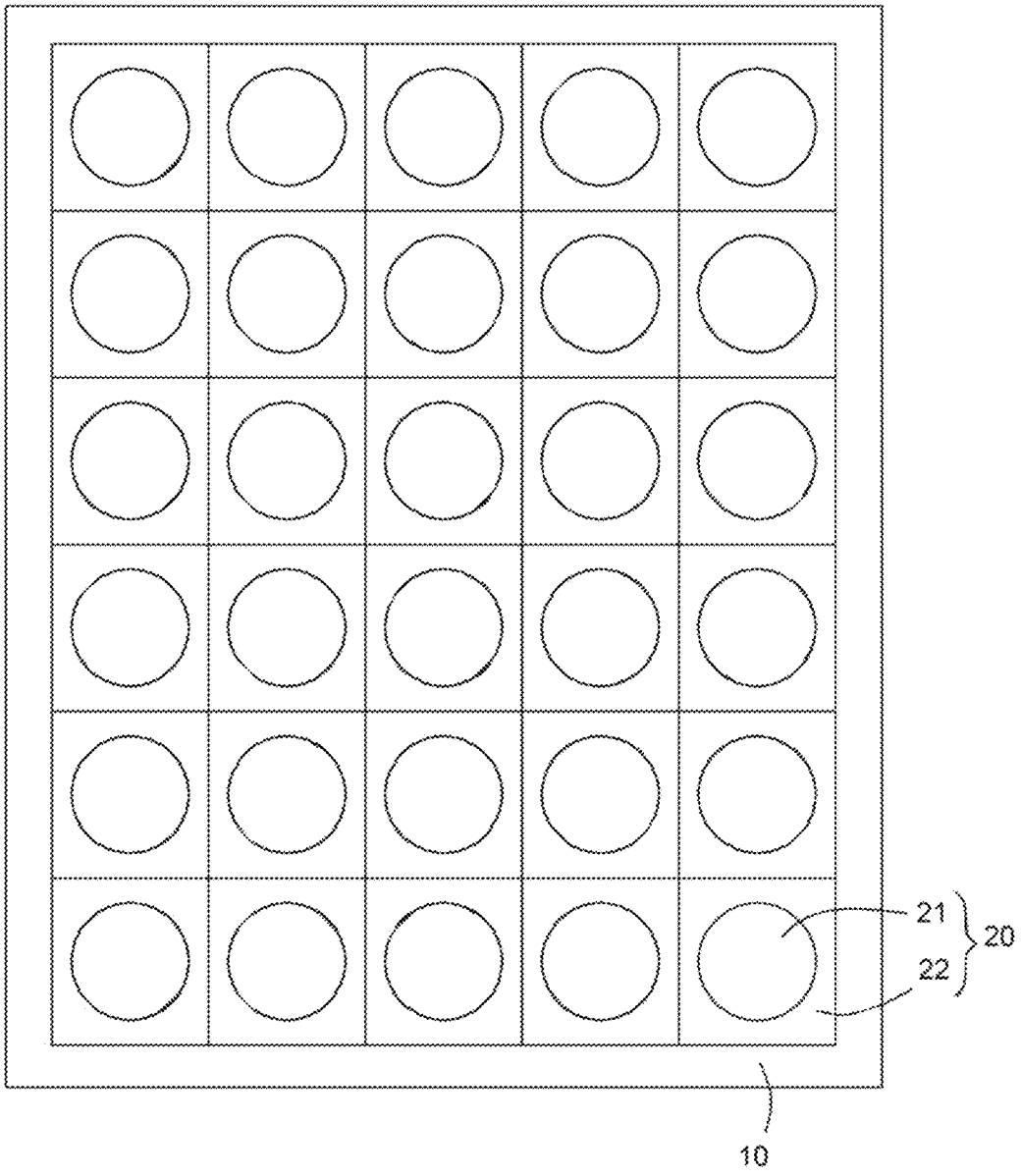
FIG. 14 is a top view showing the balancing pressure bearing apparatus of the fifth embodiment of the invention where the upper layer bodies are circular.

FIG. 13 is a top view showing a balancing pressure bearing apparatus of a fifth embodiment of the invention where the upper layer bodies are rectangular. FIG. 14 is a top view showing the balancing pressure bearing apparatus of the fifth embodiment of the invention where the upper layer bodies are circular.

Referring to FIG. 13 and FIG. 14, the balancing pressure bearing apparatus of the fifth embodiment of the invention is shown. Herein, each of the bearing components 20 is arranged evenly above the connecting base 10 for bearing the human body to serve as a mattress, headrest or backrest product.

It should be emphasized that the above description is made on embodiments of the present invention. However, the embodiments are not intended to limit the scope of the present invention, and all equivalent implementations or alterations within the spirit of the present invention still fall within the scope of the present invention.

What is claimed is:

1. A balancing pressure bearing apparatus, comprising:

a connecting base, being enclosed, and a material thereinside being any one selected from a volume-incompressible fluid, semifluid and elastic element, and the outside of the connecting base being deformed for adapting to an external pressure to generate a connecting pipe phenomenon and a Pascal (Pa) phenomenon; and a plurality of bearing components, a material of each of the bearing components being selected from either an elastic material or a rigid material, each of the bearing components being separately arranged above the connecting base, and each of the bearing components comprising an upper layer body and a lower layer body;

wherein the separately arranged bearing components serve as supportive bearing surfaces for any part of a human body when pressing down in left and right, front and back, or inside and outside asymmetry, or in a tilting asymmetric state, and are capable of pressure reduction, and when the bearing components bear any part of the human body and press down the connecting base, the Pa phenomenon is generated by the volume incompressibility of the fluid, semifluid or elastic element, such that a pressure applied to the fluid, semifluid or elastic element by the bearing components is transmitted equally through the fluid, semifluid or elastic element, and each portion of the fluid, semifluid or elastic element has the same pressure, thereby balancing the pressure on the supportive bearing surfaces pressed by any two parts of the human body.

2. The balancing pressure bearing apparatus according to claim 1, wherein the one of the fluid, semifluid and elastic element selected for the inside of the connecting base further comprises any one of silicone oil, jelly silicone, low hardness silicone and latex.

3. The balancing pressure bearing apparatus according to claim 1, wherein the connecting base is provided on a bearing base, and the bearing base is provided with a concaved accommodation space for arranging the connecting base and provides an enclosed space with a fixed volume.

4. The balancing pressure bearing apparatus according to claim 1, wherein the upper layer body of each of the bearing components is an elastic element or a rigid element, and the lower layer body of each of the bearing components is a rigid element.

5. The balancing pressure bearing apparatus according to claim 1, wherein a material of each of the bearing components is selected from a high hardness silicone.

6. The balancing pressure bearing apparatus according to claim 1, wherein each of the bearing components is arranged in a left and right symmetry manner above the connecting base for correspondingly bearing any two parts of the body parts to serve as a cushion, chair seat or backrest product.

7. The balancing pressure bearing apparatus according to claim 1, wherein the upper layer body of each of the bearing components is smaller than the lower layer body of each of the bearing components, such that the upper layer bodies of the bearing components have a spacing distance from each other for defining a zero-pressure region, and the lower layer bodies lean against each other on their sides, and are independently separated but in an enclosed plane for defining a balanced-pressure region.

8. The balancing pressure bearing apparatus according to claim 1, wherein a left bearing component arrangement region and a right bearing component arrangement region are defined above the connecting base, the plurality of bearing components are arranged in the left bearing component arrangement region and the right bearing component arrangement region, and there is a spacing distance between the left bearing component arrangement region and the right bearing component arrangement region for defining a zero-pressure region in the middle.

9. The balancing pressure bearing apparatus according to claim 1, wherein the upper layer body of each of the bearing components is smaller than the lower layer body of each of the bearing components, such that the upper layer bodies of the bearing components have a spacing distance from each other for defining a zero-pressure region, the lower layer bodies define a balanced-pressure region, the lower layer body of each of the bearing components further defines a plurality of separated sub lower layer bodies, and the sub lower layer bodies lean against each other on their sides, and are independently separated but in an enclosed plane, thereby defining the balanced-pressure region for conforming or adapting to asymmetric body parts or posture asymmetry.

10. The balancing pressure bearing apparatus according to claim 1, wherein each of the bearing components is arranged evenly above the connecting base for bearing the human body to serve as a mattress, headrest or backrest product.

* * * * *